US009050567B2

(12) United States Patent
Hoefken

(10) Patent No.: US 9,050,567 B2
(45) Date of Patent: Jun. 9, 2015

(54) VERTICAL AGITATOR FOR WASTEWATER RECEIVED IN A SEDIMENTATION TANK

(75) Inventor: Marcus Hoefken, Erlangen (DE)

(73) Assignee: INVENT UMWELT-und VERFAHRENSTECHNIK AG, Erlangen (DE)

( * ) Notice: Subject to any disclaimer, the term of this patent is extended or adjusted under 35 U.S.C. 154(b) by 296 days.

(21) Appl. No.: 13/520,974

(22) PCT Filed: Dec. 28, 2010

(86) PCT No.: PCT/EP2010/070804
§ 371 (c)(1),
(2), (4) Date: Aug. 10, 2012

(87) PCT Pub. No.: WO2011/083063
PCT Pub. Date: Jul. 14, 2011

(65) Prior Publication Data

US 2012/0307587 A1 Dec. 6, 2012

(30) Foreign Application Priority Data

Jan. 7, 2010 (DE) ..... 10 2010 000 730

(51) Int. Cl.
*B01F 7/00* (2006.01)
*B01F 15/00* (2006.01)
*B01F 7/20* (2006.01)

(52) U.S. Cl.
CPC ..... *B01F 7/00541* (2013.01); *B01F 15/00688* (2013.01); *B01F 7/20* (2013.01); *B01F 15/00707* (2013.01)

(58) Field of Classification Search
CPC ..... B01F 15/00668; B01F 15/00688
USPC ..... 366/331; 384/242, 252, 428
See application file for complete search history.

(56) References Cited

U.S. PATENT DOCUMENTS

| | | | | | |
|---|---|---|---|---|---|
| 3,356,349 | A | * | 12/1967 | Keppler | 366/274 |
| 5,088,832 | A | * | 2/1992 | Gambrill et al. | 366/314 |
| 5,535,665 | A | * | 7/1996 | Wong | 99/348 |
| 5,618,107 | A | * | 4/1997 | Bartsch | 366/279 |
| 5,716,013 | A | * | 2/1998 | Benson et al. | 241/33 |
| 6,089,746 | A | * | 7/2000 | Martin | 366/129 |

(Continued)

FOREIGN PATENT DOCUMENTS

| | | |
|---|---|---|
| DE | 198 26 098 A 1 | 12/1999 |
| DE | 10 2005 041 798 A1 | 3/2007 |
| DE | 10 2005 049 373 A1 | 4/2007 |
| DE | 20 2006 020 195 U1 | 1/2008 |

(Continued)

*Primary Examiner* — Walter D Griffin
*Assistant Examiner* — Marc C Howell
(74) *Attorney, Agent, or Firm* — Manabu Kanesaka

(57) ABSTRACT

The invention relates to a vertical agitator for wastewater and the like received in a sedimentation tank, wherein an agitator tool (5) is mounted on a drive shaft (4) extending vertically from a drive (1) mounted above a tank floor (2), wherein a free end (E2) of a shaft section (7) extending from the agitator tool (5) in the direction of the tank floor (2) is held in a safety bearing (14), wherein the safety bearing (14) is held in a retaining device (8) supported on the tank floor (2), wherein the retaining device (8) comprises a receiving section (9) for a receiving device (12) receiving the safety bearing (14). In order to simplify installation, the invention proposes that the receiving section (9) comprises a recess (11) opening in a substantially horizontal direction for laterally inserting the shaft section (7).

9 Claims, 4 Drawing Sheets

(56) References Cited

U.S. PATENT DOCUMENTS

Figure 1:
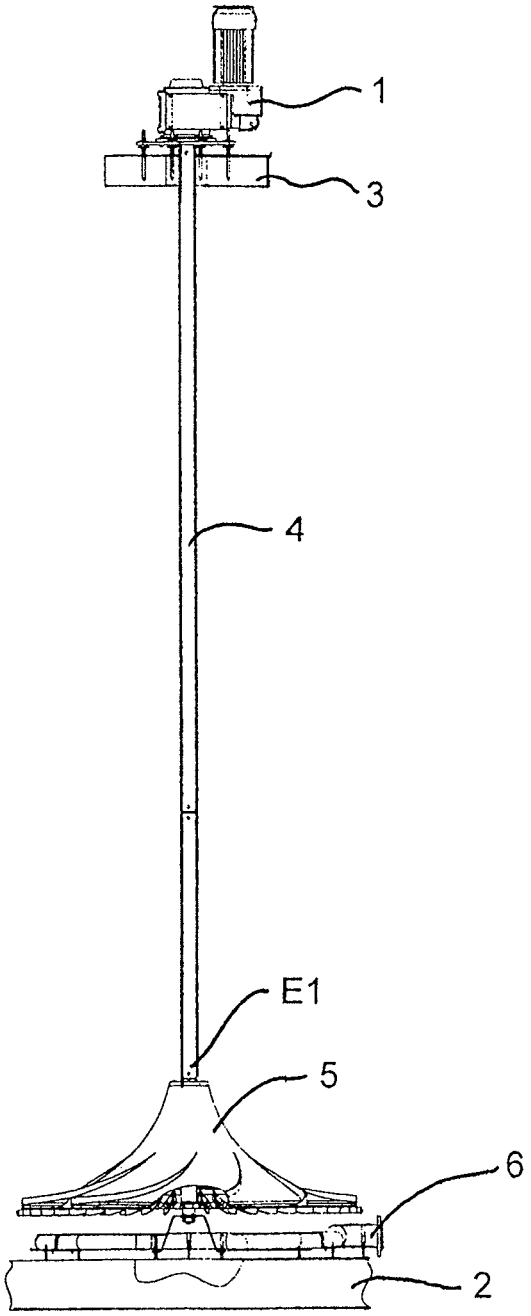

| | | | | |
|---|---|---|---|---|
| 2002/0176322 | A1 | 11/2002 | Kupidlowski | |
| 2009/0127213 | A1 * | 5/2009 | Hoefken | 210/800 |

FOREIGN PATENT DOCUMENTS

| | | | |
|---|---|---|---|
| DE | 10 2007 034 463 | A1 | 1/2009 |
| WO | WO 03/095081 | A1 | 11/2003 |

* cited by examiner

VERTICAL AGITATOR FOR WASTEWATER RECEIVED IN A SEDIMENTATION TANK

RELATED APPLICATIONS

The present application is National Phase of International Application No. PCT/EP2010/070804 filed Dec. 28, 2010, and claims priority from German Application No. 10 2010 000 730.7, filed Jan. 7, 2010.

The invention relates to a vertical agitator according to the preamble of claim 1.

A vertical agitator of this type is known, for example, from WO 03/095081. In the known vertical agitator, a drive is attached to a tower-like frame above a tank floor. A drive shaft extends vertically from the drive and is connected to a hyperboloid-type agitator tool. From a bottom side of the agitator tool, a shaft section extends in the direction of the tank floor, with the unattached end of said shaft section being accommodated in a safety bearing. The safety bearing is held in a retaining device supported on the tank floor. The retaining device is a component of the tower-like frame. A receiving device is provided for receiving the safety bearing and ordinarily comprises a sleeve that is mounted on a plate. The sleeve encompasses the safety bearing and is fastened to the retaining device by means of the plate.

With the known vertical agitator, the retaining device is a component of a complex, tower-like frame. A tower-like frame of this type is well suited for applications in which only a single vertical agitator per sedimentation tank is provided. In contrast, particularly with large sedimentation tanks multiple vertical agitators are used. In this case, the drives of the vertical agitators are ordinarily provided on a bridge that spans the tank. For mounting such vertical agitators, first the drive shaft is attached to the drive. The drive, together with the drive shaft, is then fastened to the bridge such that the drive shaft is suspended freely in the direction of the tank floor. A retaining device for holding the safety bearing is then fastened to the tank floor, vertically below the drive shaft. The drive is then loosened again and raised together with the drive shaft. The hyperboloid-type agitator is then inserted with its shaft section into the safety bearing that is held in the retaining device, wherein the agitator must be held in a raised position. The drive and the drive shaft attached thereto are then lowered. The drive is again fastened to the bridge; the drive shaft is fastened to the agitator body. The conventional mounting method is laborious and time-consuming. In the final assembly, it cannot always be guaranteed that the drive is properly centered in relation to the safety bearing.

The problem addressed by the invention is that of overcoming the disadvantages according to the prior art. More particularly, a vertical agitator that can be assembled as easily and as quickly as possible is to be provided. According to a further goal of the invention, a method for assembling the vertical agitator that can be carried out as easily and as quickly as possible is to be provided.

This problem is solved by the features of claims 1 and 7. Expedient embodiments of the invention result from the features of claims 2 to 6 and 8.

According to the invention, it is provided that the receiving section has a recess that is open in a substantially horizontal direction for the lateral insertion of the shaft section. This enables a substantial simplification of assembly of the vertical agitator. Particularly, it is no longer necessary to fasten the drive multiple times during assembly. Moreover, an improper alignment of the drive shaft in relation to the safety bearing can be avoided.

According to an advantageous embodiment, the receiving device has a sleeve, attached to a plate, for receiving the safety bearing. The sleeve can project through the plate or can be attached to the plate. The plate is expediently provided with multiple through openings for inserting mounting bolts. The receiving device can be produced as a single piece made of metal.

The receiving section advantageously has elongated holes for aligning and fastening the plate. The elongated holes correspond to the through openings provided in the plate, so that the plate can be fastened to the receiving section, for example, by means of bolts. It is possible to shift the plate relative to the receiving section by means of the bolts within the elongated holes, so that the plate can be aligned relative to the receiving section and can be fastened in the aligned position.

Advantageously, the receiving section is connected to a support section that can be supported against the base. The function of the support section is to hold the receiving section at a predefined distance above the base. The distance can be 20 to 50 cm, preferably 30 to 40 cm. Providing the support section facilitates the lateral insertion of the shaft section and the mounting of the receiving device on the receiving section.

According to a further advantageous embodiment, the receiving section and the support section are produced as a single integral piece from a metal plate. Particularly, they can be produced easily and cost-effectively by providing through openings and by bending the metal plate.

The agitator tool can advantageously be a hyperboloid agitator. Thereby, a current can be generated in the wastewater or the like in a particularly efficient manner.

The proposed vertical agitator can be assembled easily and quickly. In this, a method comprising the following steps can be implemented:

Mounting the drive and the drive shaft such that the drive shaft is suspended above the tank floor, Anchoring the retaining device in the tank floor such that the recess is located beneath the drive shaft, Arranging the agitator tool at the end of the drive shaft, wherein the shaft section is inserted laterally into the recess of the receiving section, Mounting the agitator tool at the end of the drive shaft, and Mounting the receiving device on the receiving section such that the unattached end of the shaft section is received in the safety bearing.

The proposed method no longer requires that the drive be fastened multiple times. The device can be assembled quickly, and can simultaneously be precisely aligned.

According to an advantageous embodiment, at least sections of the retaining device are cast in concrete after being finally anchored in the tank floor. This increases the durability and stability of the retaining device.

Figure 2:
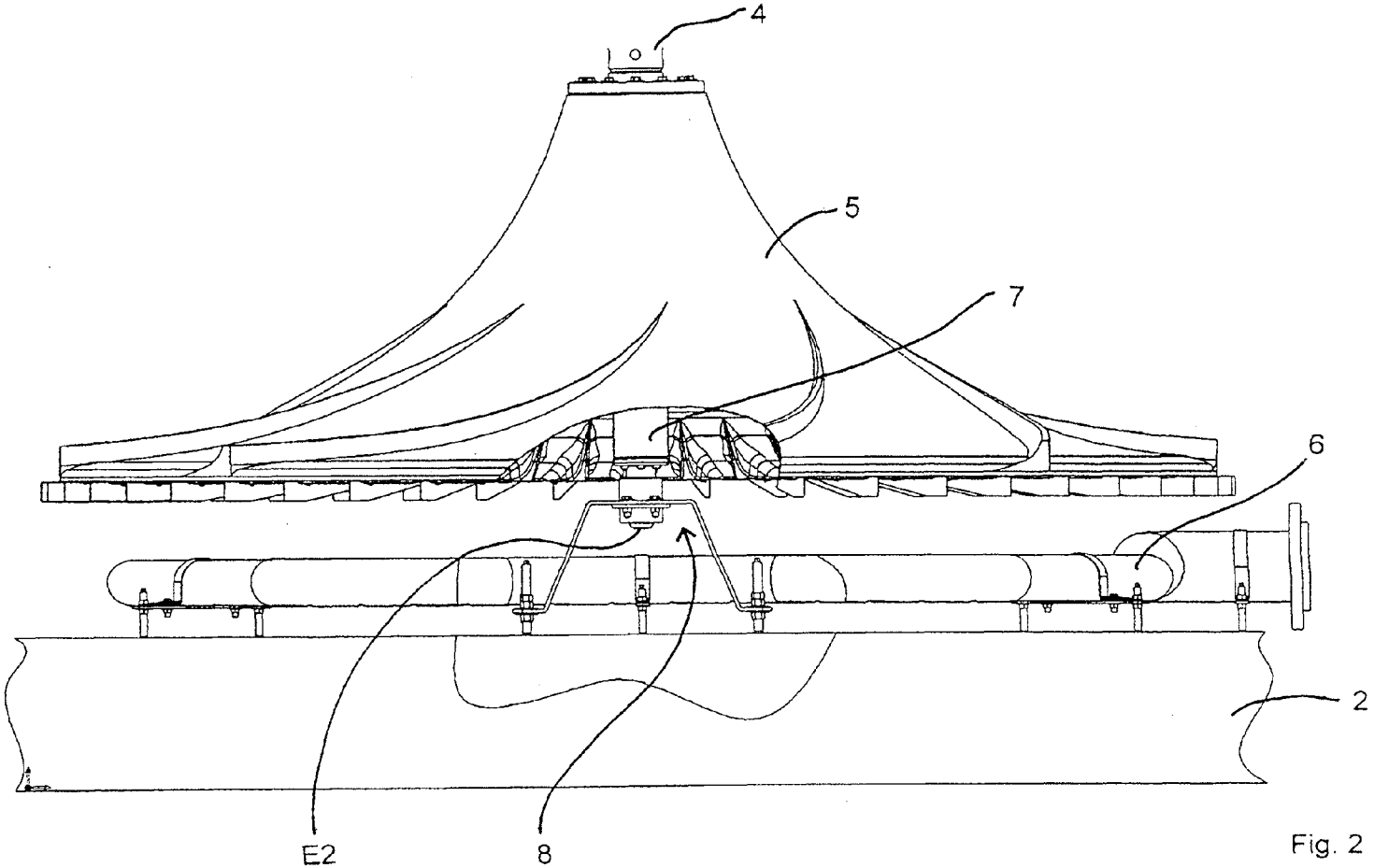
Figure 3:
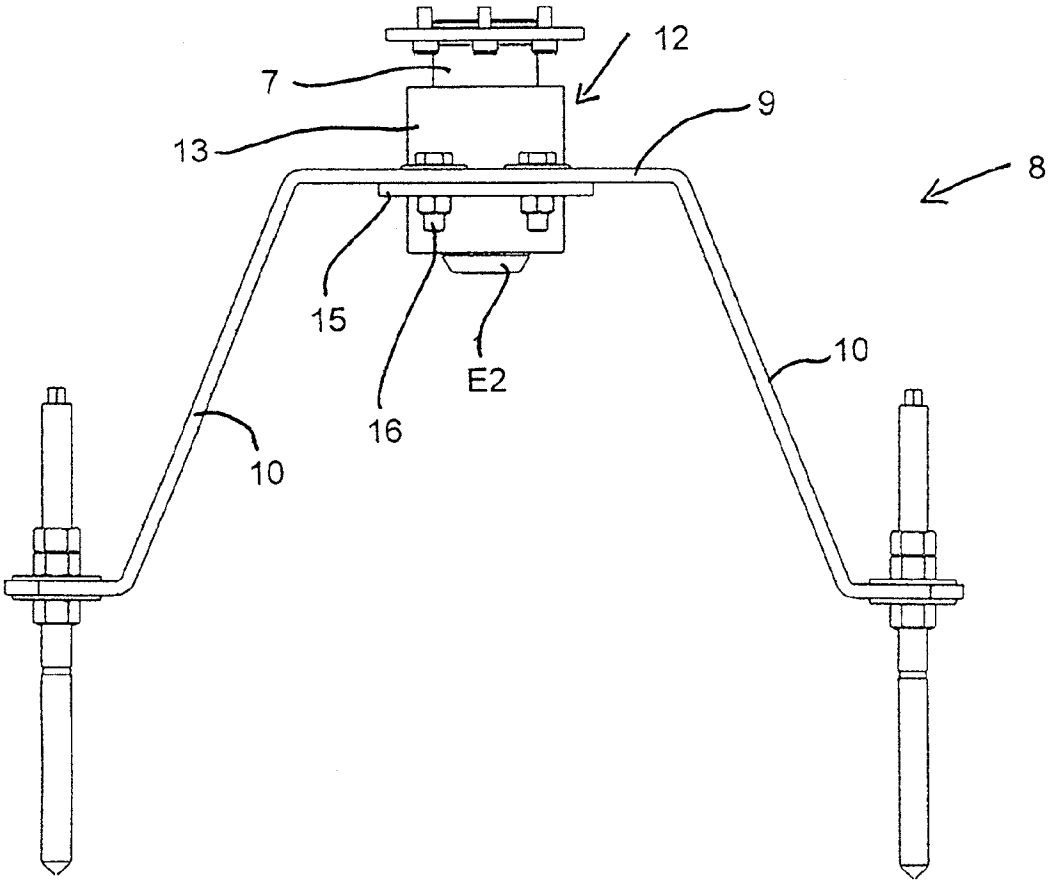
Figure 4:
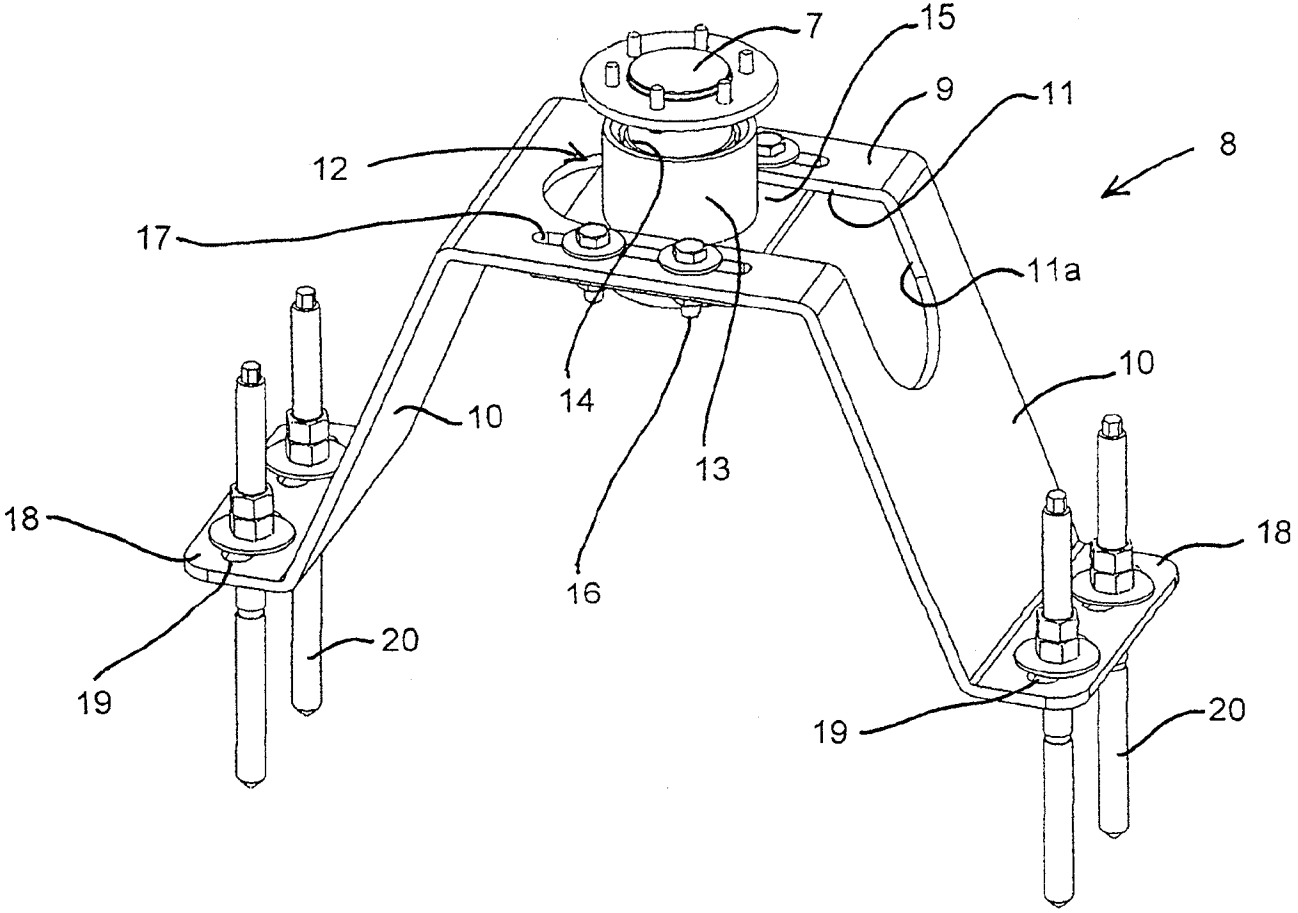

In what follows, an embodiment example of the invention will be specified in greater detail in reference to the set of drawings. The drawings show:

FIG. 1 a side view of a vertical agitator,

FIG. 2 an enlarged detailed view of the hyperboloid agitator body according to FIG. 1, FIG. 3 a side view of the retaining device and FIG. 4 a perspective view of the retaining device according to FIG. 3.

In the vertical agitator shown in FIG. 1, a drive 1 is fastened above a tank floor 2, e.g., on a bridge 3 that spans the tank (not shown here in detail). The tank floor 2 extends in a horizontal direction. From the drive 1, a drive shaft 4 extends in a vertical direction, at the end E1 of which a hyperboloid agitator body 5 is attached. Between the tank floor 2 and the hyperboloid agitator body 5, a ring line 6 is provided for supplying air to an area below the hyperboloid agitator body 5.

As is clear particularly from FIG. 2, a shaft section 7 extends from a bottom side of the hyperboloid agitator body 5 in the direction of the tank floor 2. An unattached end E2 of the shaft section 7 is held in a retaining device generally identified by reference sign 8.

FIGS. 3 and 4 illustrate the retaining device 8 in detail. Said retaining device 8 has a receiving section 9 that extends substantially horizontally, and two support sections 10 extending obliquely from the receiving section 9 in the direction of the tank floor 2 at an angle of 60-80°. The receiving device 9 has a recess 11, through which the unattached end E2 of the shaft section 7 can be inserted laterally. The recess 11 advantageously continues as additional recess 11*a* in one of the two support sections 10.

Reference sign 12 identifies a receiving device which has a sleeve 13 for receiving a safety bearing 14. The sleeve 13 projects through a plate 15, which is detachably fastened to the receiving section 9, preferably by means of bolts 16. The bolts 16 are inserted through elongated holes 17 provided in the receiving section 9, and through openings in the plate 15 (not visible here).

Each of the support sections 10 has at its end an angled section 18, which extends substantially horizontally and is provided with two additional elongated holes 19. Anchor bolts 20 are inserted through the additional elongated holes 19, allowing the retaining device 8 to be fastened to the tank floor 2. The anchor bolts 20 are configured such that the retaining device 8 can be aligned in terms of its height and in a direction perpendicular to the elongated holes 17.

The vertical agitator according to the invention is assembled as follows:

First, the drive shaft 4 is mounted on the drive 1. The drive 1 is then mounted on the bridge 3, or the like, such that the drive shaft 4 extends suspended in the direction of the tank floor 2. Afterward, a perpendicular is dropped below the suspended drive shaft 4 onto the tank floor 2. The retaining device 8 is then affixed to the tank floor 2 using the anchor bolts 20 in such a way that the dropped perpendicular is located inside the recess 11.

The hyperboloid agitator body 5 is then transported to the area below the end E1 of the drive shaft 4, for example, by means of a forklift. In this, the unattached end E2 of the shaft section 7 is simultaneously inserted laterally into the recess 11 and the additional recess 11*a* of the retaining device 8. The hyperboloid agitator body 5 is then fastened to the end E1 of the drive shaft 4.

The receiving device 12 is then pushed from the bottom onto the unattached end E2. The plate 15 is aligned with and affixed to the receiving section 9 by means of the bolts 16. Finally, the mounting anchors 20 are aligned with and affixed to the angled sections 18. Particularly, the angled sections 18 and sections of the support sections 10 can then be cast in concrete. With this, the assembly of the vertical agitator is completed. Afterward, the ring line 6 can be mounted on the tank floor 2.

LIST OF REFERENCE SIGNS

1 Drive
2 Tank floor
3 Bridge
4 Drive shaft
5 Hyperboloid agitator body
6 Ring line
7 Shaft section
8 Retaining device
9 Receiving section
10 Support section
11 Recess
11*a* Additional recess
12 Receiving device
13 Sleeve
14 Safety bearing
15 Plate
16 Bolts
17 Elongated hole
18 Angled section
19 Additional elongated hole
20 Anchor bolt
E1 End
E2 Unattached end

The invention claimed is:

1. A vertical agitator for wastewater received in a sedimentation tank, comprising:

a drive having a drive shaft extending vertically from the drive and attached above a tank floor of the tank;

a retaining device supported on the tank floor; and an agitator tool attached to the drive shaft, and having a shaft section extending from the agitator tool in a direction of the tank floor, wherein an unattached end of the shaft section is held in a safety bearing held in the retaining device, and wherein the retaining device has a receiving section including a receiving device having a sleeve attached to a plate that receives the safety bearing and the receiving section has a recess that opens in a substantially horizontal direction to laterally insert the receiving device with the safety bearing and the shaft section into the recess.

2. The vertical agitator according to claim 1, wherein the receiving section has elongated holes for aligning the plate.

3. The vertical agitator according to claim 1, wherein the receiving section is connected to a support section adapted to be supported against the tank floor.

4. The vertical agitator according to claim 3, wherein the receiving section and the support section are an integral piece of a metal plate.

5. The vertical agitator according to claim 1, wherein the agitator tool is a hyperboloid agitator body.

6. The vertical agitator according to claim 1, wherein the sleeve surrounds the safety bearing.

7. The vertical agitator according to claim 1, wherein the receiving section has the plate on a bottom side thereof.

8. A method for assembling a vertical agitator for wastewater received in a sedimentation tank, the vertical agitator comprising:

a drive having a drive shaft extending vertically from the drive and attached above a tank floor of the tank;

a retaining device supported on the tank floor; and an agitator tool attached to the drive shaft, and having a shaft section extending from the agitator tool in a direction of the tank floor, wherein an unattached end of the shaft section is held in a safety bearing held in the retaining device, and wherein the retaining device has a receiving section including a receiving device having a sleeve attached to a plate that receives the safety bearing and the receiving section has a recess that opens in a substantially horizontal direction to laterally insert the receiving device with the safety bearing and the shaft section into the recess, the method comprising:

mounting the drive and the drive shaft such that the drive shaft is suspended above the tank floor, anchoring the retaining device in the tank floor such that the recess is located below the drive shaft, arranging the agitator tool at an end of the drive shaft, wherein the shaft section is inserted laterally into the recess of the receiving section, mounting the agitator tool at the end of the drive shaft, and mounting the receiving device on the receiving section such that the unattached end of the shaft section is received in the safety bearing.

9. The method according to claim 8, wherein at least sections of the retaining device are cast in concrete.

* * * * *